US005847308A

United States Patent [19]

Singh et al.

[11] Patent Number: 5,847,308

[45] **Date of Patent: *Dec. 8, 1998**

[54] PASSIVE ROOF ARMOR

[75] Inventors: Paul P. Singh, Fremont; Mark Albert Middione, Scotts Valley, both of Calif.

[73] Assignee: United Defense, LP, Arlington, Va.

[ * ] Notice: The term of this patent shall not extend beyond the expiration date of Pat. No. 5,705,765.

[21] Appl. No.: 928,945

[22] Filed: Sep. 12, 1997

Related U.S. Application Data

[63] Continuation of Ser. No. 657,717, May 30, 1996, Pat. No. 5,705,765.

[51] Int. Cl.[6] ..... F41H 5/04; F41H 7/04

[52] U.S. Cl. ..... 89/36.08; 89/36.02

[58] Field of Search ..... 89/36.01, 36.02, 89/36.04, 36.07, 36.08; 428/911; 109/49.5, 80

[56] References Cited

U.S. PATENT DOCUMENTS

| | | | |
|---|---|---|---|
| 3,616,115 | 10/1971 | Klimmek | 109/84 |
| 3,917,891 | 11/1975 | Cooke et al. | 428/337 |
| 4,243,719 | 1/1981 | Holmes | 428/442 |
| 4,774,143 | 9/1988 | Gondela et al. | 428/442 |
| 4,812,359 | 3/1989 | Hall | 428/332 |
| 5,370,034 | 12/1994 | Turner et al. | 89/36.02 |

FOREIGN PATENT DOCUMENTS

| | | | |
|---|---|---|---|
| 3134341 | 5/1982 | Germany | 89/36.02 |

*Primary Examiner*—Stephen M. Johnson
*Attorney, Agent, or Firm*—Douglas W. Rudy; Michael B. K. Lee

[57] ABSTRACT

The invention provides an improved passive armor system. The armor system uses armor stacks of ceramic tiles connected to layers of glass. The armor stacks are then adhered to the inside of a cover box. The cover box is then secured to a base and then covered with a cloth impregnated with an adhesive.

9 Claims, 2 Drawing Sheets

PASSIVE ROOF ARMOR

This application is a continuation of application Ser. No. 08/657,717, May 30, 1996 now U.S. Pat. No. 5,705,765.

BACKGROUND OF THE INVENTION

The present invention relates generally to passive armor.

In the prior art, armor for the roof of military vehicles were unable to defeat bomblet type threats.

SUMMARY OF THE INVENTION

It is an object of the invention to provide a roof armor that is able to defeat bomblet type or other multihit threats.

It is another object of the invention to provide a lighter and more efficient passive armor.

The invention provides a unique configuration of layers of glass, steal, ceramic and epoxy, that provides an efficient passive armor.

DESCRIPTION OF THE PREFERRED EMBODIMENTS

Figure 1:
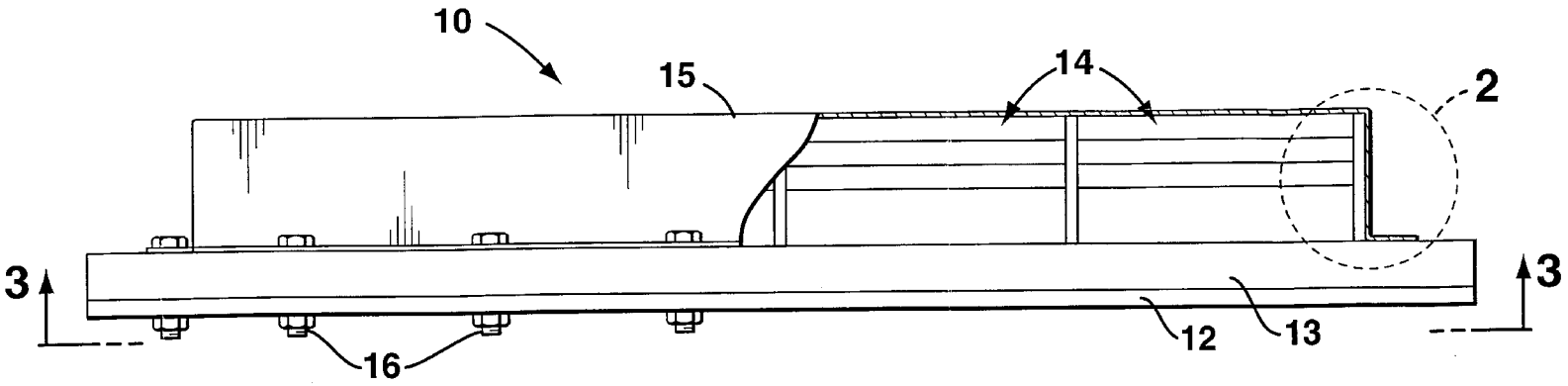
FIG. 1 is a cut away view of a preferred embodiment of the invention.

A passive armor system 10, as shown in FIGS. 1 through 4, comprises first base plate 12, a second base plate 13, a plurality of armor stacks 14, a cover box 15, a plurality of bolts 16, and an outer skin 17. Such a passive armor system 10 may be used on a military vehicle or a shelter.

Figure 2:
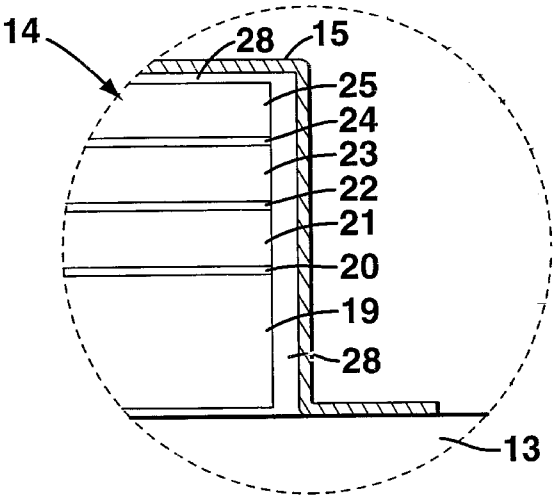
FIG. 2 illustrates an enlarged view part of the embodiment illustrated in FIG. 1.
Figure 3:
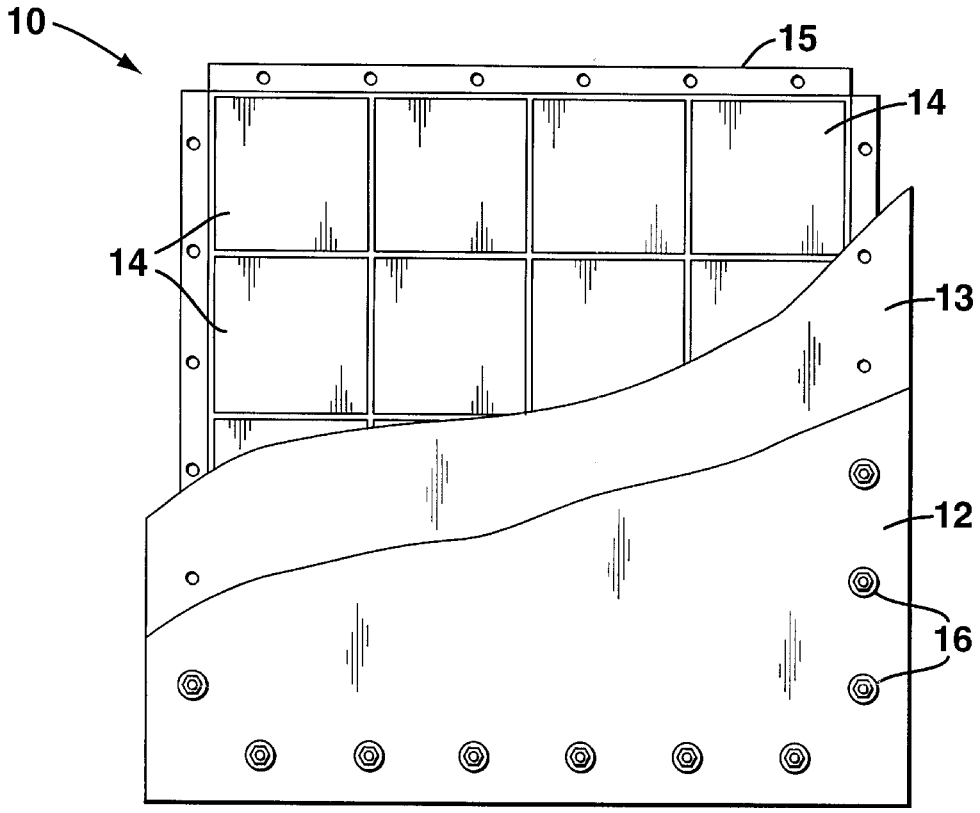
FIG. 3 is another cut away view of the embodiment illustrated in FIG. 1 along lines 3—3.
Figure 4:
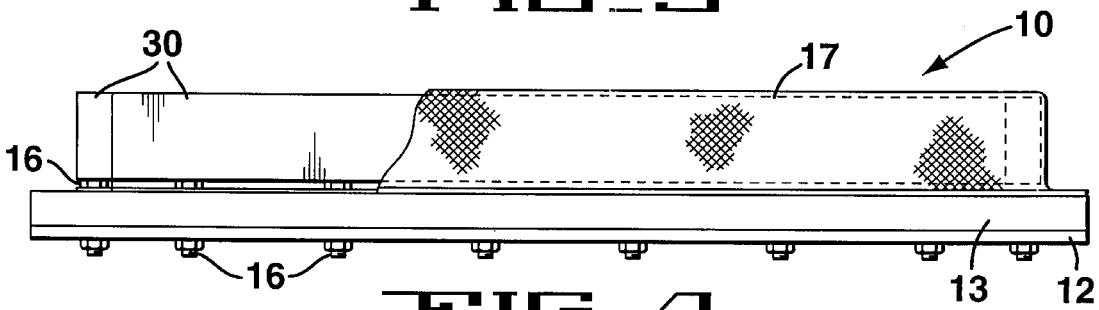
FIG. 4 is a cut away view of the embodiment illustrated in FIG. 1, with additional covering.

In the manufacture of the preferred embodiment the plurality of armor stacks 14 are assembled. FIG. 2 provides a detailed view of an armor stack of the plurality of armor stacks 14. In the assembly of an armor stack, a first layer of adhesive 20 is applied to a first side of a tile 19. A first sheet of glass 21, is placed on the first layer of adhesive 20 so that a first side of the first sheet of glass 21 is contiguous with the first layer of adhesive 20 as shown, and with the first layer of adhesive 20 between the first side of the ceramic tile 19 and the first side of the first sheet of glass 21. A second layer of adhesive 22 is placed on a second side of the first sheet of glass 21. A first side of a second sheet of glass 23 is placed on the second layer of adhesive 22. A third layer of adhesive 24 is placed on a second side of the second sheet of glass 23. A first side of a third sheet of glass 25 is placed on the third layer of adhesive 24. In the preferred embodiment, the tile 19 is a ceramic tile which is made of silicon carbide. The tile 19 is 1.18 inches thick. Various types of ceramics can be used and is not limited to silicon carbide. The first, second, and third sheets of glass 21, 23, 25 are Pyrex and between 0.25 inches to 1 inch thick. The first, second, and third layers of adhesive 20, 22, 24 are of SC-11 flexible epoxy and are between 0.015 inches and 0.1 inches thick. Wire shims are used to provide the desired thickness of the first, second, and third layers of adhesive 20, 22, 24 and to reduce the bubbles in these layers.

The cover box 15 forms five sides of a box with an open side, with a face opposite from the open side of the cover box 15, forming the largest surface area of the cover box 15, and with a flange surrounding the remaining sides of the cover box 15. A layer of adhesive is applied to the inner surface of the face of the cover box 15. The plurality of armor stacks 14 are placed in the cover box 15, with the third sheet of glass 25 placed on the layer of adhesive applied to the inner face of the cover box 15. Preferably, the plurality of armor stacks 14 are spaced in a range between 0.015 inches and 0.250 inches apart. Adhesive is poured to fill the remaining spaces between the armor stacks 14 in the cover box 15, forming an adhesive matrix 28. In the preferred embodiment, wire shims are used to provide desired spacings between the armor stacks 14. The adhesive matrix is of SC-11 flexible epoxy. The cover box 15 is made of steel and is between 0.06 inches and 0.2 inches thick.

After the adhesive matrix 28 has cured, the first base plate 12 and the second base plate 13 are bolted to the flange surrounding the cover box 15 with a plurality of bolts 16 to cover the open side of the cover box 15. In the preferred embodiment of the invention, the first base plate is steal and between 0.25 inches and 0.5 inches thick. The second base plate is titanium and is between 0.5 inches and 2 inches thick.

Spacers 30 are placed over the heads of the plurality of bolts 16. An outer skin 17 is placed over the spacers and the cover box 15, where the outer skin 17 is a cloth impregnated with an adhesive. In the preferred embodiment, the spacers are of balsa wood. The adhesive is SC-11 flexible epoxy.

The armor system 10 is attached to a hull of a vehicle or structure. In the preferred embodiment, the armor system is attached to the roof of an armored vehicle.

Figure 5:
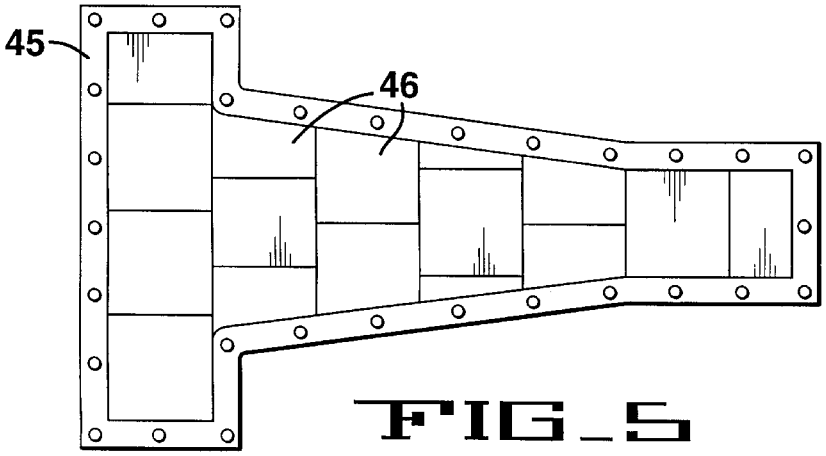
FIG. 5 is a view of another embodiment of the invention.

FIG. 5 illustrates another embodiment of a box cover 45 with a plurality of armor stacks 46. In this embodiment, the armor stacks 46 are staggered so that corners of four armor stacks 46 do not meet at a single point as in the previous embodiment. This provides greater protection in a multihit situation.

While preferred embodiments of the present invention have been shown and described herein, it will be appreciated that various changes and modifications may be made therein without departing from the spirit of the invention as defined by the scope of the appended claims.

What is claimed is:

1. An armor system, comprising:

a plurality of armor stacks, wherein each armor stack comprises;

a ceramic tile with a first side and a second side;

a first layer of adhesive on the first side of the ceramic tile;

a first sheet of glass with a first side and a second side, wherein the first side of the first sheet of glass is contiguous to the first layer of adhesive;

a second layer of adhesive on the second side of the first sheet of glass;

a second sheet of glass with a first side and a second side, wherein the first side of the second sheet of glass is contiguous to the second layer of adhesive; and a cover box, with an open side and with an interior and exterior wherein the plurality of armor stacks are on the interior of the cover box.

2. The armor system, as recited in claim 1, further comprising a first base plate covering the open side of the cover box and mechanically connected to the cover box.

3. The armor system, as recited in claim 2, further comprising a second base plate covering the open side of the cover box and mechanically connected to the cover box.

4. The armor system, as recited in claim 3, further comprising, a cloth impregnated with an adhesive covering the exterior of the cover box.

5. An armor system, comprising:

a plurality of armor stacks, wherein each armor stack comprises;

an opaque ceramic tile with a first side and a second side;

a first layer of adhesive on the first side of the opaque ceramic tile;

a first sheet of glass with a first side and a second side, wherein the first side of the first sheet of glass is contiguous to the first layer of adhesive;

a second layer of adhesive on the second side of the first sheet of glass; and a second sheet of glass with a first side and a second side, wherein the first side of the second sheet of glass is contiguous to the second layer of adhesive.

6. The armor system, as recited in claim 5, further comprising a cover box, with an open side and with an interior and exterior wherein the plurality of armor stacks are on the interior of the cover box.

7. The armor system, as recited in claim 6, further comprising a first base plate covering the open side of the cover box and mechanically connected to the cover box.

8. The armor system, as recited in claim 7, further comprising a second base plate covering the open side of the cover box and mechanically connected to the cover box.

9. The armor system, as recited in claim 8, further comprising, a cloth impregnated with an adhesive covering the exterior of the cover box.

* * * * *